US008007637B2

(12) United States Patent
Liu et al.

(10) Patent No.: US 8,007,637 B2
(45) Date of Patent: Aug. 30, 2011

(54) METHOD FOR PRODUCING FLUE-CURED TYPE TOBACCO SHEET BY PAPERMAKING PROCESS

(75) Inventors: Jianfu Liu, Changsha (CN); Xinliang Tan, Changsha (CN); Jianshan Fu, Changsha (CN); Dafeng Yin, Changsha (CN); Changjian Deng, Changsha (CN); Gang Chen, Changsha (CN)

(73) Assignee: China Tomacco Hunan Industrial Co. Ltd. (CN)

( * ) Notice: Subject to any disclaimer, the term of this patent is extended or adjusted under 35 U.S.C. 154(b) by 778 days.

(21) Appl. No.: 12/088,388

(22) PCT Filed: Mar. 24, 2006

(86) PCT No.: PCT/CN2006/000485

§ 371 (c)(1),
(2), (4) Date: Mar. 27, 2008

(87) PCT Pub. No.: WO2007/036093

PCT Pub. Date: Apr. 5, 2007

(65) Prior Publication Data

US 2008/0245378 A1 Oct. 9, 2008

(30) Foreign Application Priority Data

Sep. 28, 2005 (CN) ..... 2005 1 0032199

(51) Int. Cl.
*D21H 11/12* (2006.01)
*A24B 3/14* (2006.01)
*A24B 15/12* (2006.01)

(52) U.S. Cl. ..... 162/99; 131/374; 131/354; 131/357

(58) Field of Classification Search ..... 162/91, 162/99, 139; 131/354, 356, 357, 374
See application file for complete search history.

(56) References Cited

U.S. PATENT DOCUMENTS 720,830 A * 2/1903 Marsden ..... 131/358
3,415,253 A * 12/1968 Michels et al. ..... 131/373
4,182,349 A * 1/1980 Selke ..... 131/374
4,341,228 A * 7/1982 Keritsis et al. ..... 131/354
4,421,126 A * 12/1983 Gellatly ..... 131/371

FOREIGN PATENT DOCUMENTS

CN 1033359 C 11/1996
CN 1140196 C 3/2004
CN 1565284 A 1/2005
CN 1565286 A 1/2005

OTHER PUBLICATIONS

International Search Report ; International Application No. PCT/CN2006/000485.
Written Opinion of the International Searching Authority; International Application No. PCT/CN2006/000485.
English Translation of the Abstract of CN 1565284 (CN 1565284 has previously been submitted).
English Translation of the Abstract of CN 1565286 (CN 1565286 has previously been submitted).
English Translation of the Abstract of CN 1033359C (CN 1033359C has previously been submitted).
English Translation of the Abstract of CN 1140196C (CN 1140196C has previously been submitted).

* cited by examiner

*Primary Examiner* — Eric Hug
(74) *Attorney, Agent, or Firm* — Beem Patent Law Firm

(57) ABSTRACT

This invention relates to a production process of tobacco sheet by papermaking. The technical arrangement of this invention are: (a). to immerge and to extract tobacco stem and leaf scrap respectively by water-soluble solvents to respectively obtain solid tobacco stem and solid leaf scrap, and tobacco stem extract and leaf scrap extract via solid/liquid separation; (b). to defibrilate solid tobacco stem and solid leaf scrap respectively, to mix the obtained tobacco stem fiber and leaf scrap fiber and combined with dust to prepare fiber base; (c). to wholly or partly abnegate the tobacco stem extract obtained by Step (a), and to evaporated and to concentrate other extracts that then are sprayed or immerged to coat the formed fiber base that is then dried, threshed and shaped. The tobacco sheet production process offered by this invention has improved the tobacco sheet's filling capacity and its sensory quality.

11 Claims, No Drawings

METHOD FOR PRODUCING FLUE-CURED TYPE TOBACCO SHEET BY PAPERMAKING PROCESS

This application claims priority to Chinese patent application CN-200510032199.7, filed Sep. 28, 2005, and to PCT/CN2006/0000485, filed Mar. 24, 2006.

FIELD OF THE INVENTION

This invention relates to a process for producing tobacco sheet, substantially a process for producing flue-cured type tobacco sheet using papermaking process by using tobacco wastes such as tobacco dust, stem, scrap and some parts of low-grade tobacco-leaf as raw materials.

BACKGROUND OF THE INVENTION

Tobacco sheet is a reconstituted tobacco recombinated by using tobacco wastes, such as tobacco dust, stem, scrap and some parts of low-grade tobacco-leaf formed during cigarette manufacture process. First, it can save tobacco materials as many as possible to reduce cigarette cost; second, tobacco sheet play an important role in reducing tar and minimizing the harm of cigarette. There are basically two commonly but quite different commercially employed processes used for the preparation reconstituted tobacco. One procedure, referred to commonly as band casting, employs a slurry of finely divided tobacco parts and a binder which is coated onto a steel band and then dried. The sheet made by such procedure has less filling capacity and it has less contribution to tar release reduction when it blended in cigarette composition. In addition, waste or scrap tobacco parts or dust are normally bound together by providing an adhesive to give the tobacco sheet coherence, the compound of the adhesive pyrolysis will inevitably enter into smoke during cigarette smoking, which will decrease smoke quality of cigarette. The second known process employs papermaking techniques. Its physical performances and filling capacity are much better than that made by slurry process and it can more effectively reduce tar in cigarette smoke and minimize its harm. With increased public attention focused on health and smoke, relative authorities enhance control on tar of cigarette products step by step, which makes papermaking process tobacco sheet have more and more important position in cigarette composition.

In the papermaking process, the soluble ingredients of natural tobacco are extracted. The tobacco may be macerated or comminuted in preparation for extraction. The extraction is normally performed by use of water. The extract is separated, and the insoluble fibers with or without additives are transformed into a self-sustaining web by the usual papermaking technique. The tobacco extract, which may be concentrated to a liquor, is then reapplied into the web. The application of the extracted tobacco material may be achieved in any appropriate manner, as by spraying, saturating, or otherwise.

U.S. Pat. No. 4,182,349 revealed an improvement for production method of papermaking process tobacco sheet, by which stalk is separated from other parts for respective treatment. Its target is to heavily thresh ligneous part of the stem, and then the heavily threshed stalk is mixed with other parts for further threshing. This patent also released that before threshing, the stalk and other parts are respectively extracted by water, and the extracts are mixed and concentrated, which is then coated on the sheet base shaped by slurry. The patent further disclosed that some part of stalk extract could be abnegated.

U.S. Pat. No. 4,962,774 and U.S. Pat. No. 4,131,117 revealed a production method of tobacco sheet. In these patents, tobacco stem and leaf is not treated respectively. These patents focused on the treatment of tobacco extracts. U.S. Pat. No. 4,131,117 disclosed a re-crystallization process to remove kalium salts in extract, but U.S. Pat. No. 4,962,774 suggested treatment of the extract by ammonia.

In process of tobacco sheet production by papermaking methods mentioned above, there are several technical shortcomings:

1. Because the raw materials used in production of papermaking tobacco sheet are tobacco stem and leaf scrap (their diameters are over than 1 mm), the tobacco dust or ash with size of less than 1 mm cannot be used, resulting in waste of tobacco materials.
2. The prepared tobacco sheet has heavier woody note and impurity taste that will decrease smoke quality of the sheet smoke.
3. Traditional technics of producing tobacco sheet by papermaking method is mainly based on traditional papermaking method, in which the papermaking parameters, with target to ensure paper's smooth and compactness, are used as technics parameters of its beating degree in defibrilation technics of stem and leaf scrap. But in tobacco sheet process, requirements on tobacco sheet are looseness and roughness that is directly related with filling capacity of tobacco sheet, more looseness and roughness of the tobacco sheet, the higher filling capacity will be. Therefore, the beating degree of original traditional papermaking method cannot satisfy with requirements to produce quality tobacco sheet.

Terms involved in this invention are explained as follows:

Tobacco stem: Through threshing/redrying stem-lamina separation process, leaf is separated into leaf veins and leaf body, of which the separated leaf veins is called as tobacco stem.

Leaf scrap: Through threshing/redrying stem-lamina separation process, leaf is separated into leaf veins and leaf body, of which the separated leaf body in diameter of 1~6 mm is called as leaf scrap.

Tobacco dust: In the whole tobacco treatment process, scraps formed in mechanism, transportation and etc. in sizes of 2 mm and smaller, or processed leaf scraps in sizes of 2 mm and smaller, are called as tobacco dust.

Defibrilation: It refers to threshing tobacco stem or leaf and etc. that have been treated by hot water macerating and solid/liquid separation, by using general equipment well known in the professional field.

Sheet quality evaluation: It is divided into physical characters/data evaluation and sensory quality evaluation. Physical characters/data evaluation includes tensile strength, thickness, moisture and combustibility that are tested by professional organization and professional inspection devices to judge if they are qualified or not with reference of industrial standards; sensory quality evaluation is conducted by professionally-trained expert group to evaluate smoke data such as flavor and aroma, full, irritancy, offensive taste, aftertaste, impact and etc.

DETAILED DESCRIPTION

This invention relates to a method for producing flue-cured type tobacco sheet by papermaking process to improve physical performances of the papermaking tobacco sheet such as filling value and etc., and to improve smoke sensory quality problems avoiding heavy woody note, fade flavor aroma and etc. existed in traditional papermaking tobacco sheet and to utilize tobacco dust in sizes of 2 mm-100 mesh formed in cigarette production process in order to save tobacco material and to reduce cost.

In order to solve the problems mentioned above, this invention adopts technical schemes as follows: a. to extract tobacco stem and leaf scrap respectively by an aqueous solvent, and then to separate their solid and liquid to obtain solid tobacco stem and solid leaf scrap, and tobacco stem extract and leaf scrap extract respectively; b. to defibrilate the solid tobacco stem and the solid leaf scrap respectively, and then to mix the obtained tobacco stem fiber and leaf scrap fiber to prepare fiber base; c. to abnegate all or part of tobacco stem extract liquid obtained by step (a), and to evaporate and to concentrate rest of the extract that is then sprayed or saturated on the shaped fiber base, and the extract-coated sheet is dried, threshed and packed.

The stem extract, having less contribution to smoke, most of its composition will produce offensive taste to cigarette during smoking, therefore, if such extract is coated on sheet base, it will give more woody-like offensive taste and decrease aftertaste of tobacco sheet smoke. Secondly, because the tobacco stem extract contains more sugars that will produce large amount of tar in combustion process, which will increase tar release. Thereby, this invention prefer to abnegate, wholly or partly, the tobacco stem extract.

Furthermore, this invention selects extraction temperature and time respectively for extracting tobacco stem and leaf scrap, wherein, 30-60° C. extracting temperature for leaf scrap by time of 0.5-1.5 hours; 40-70° C. extracting temperature for tobacco stem by time of 1-2.5 hours.

Defibrilation of tobacco stem refers to that: after tobacco stem is extracted by hot water and separated into solid and liquid, the solid is defibrilated by general equipment well known professionally with first defibrilation of beating degree 10-25°SR, perfectly 10-20°SR and second defibrilation of beating degree 13-26°SR, perfectly 15-22°SR. The beating degree of tobacco stem fiber finally into finished slurry is 14-30°SR, perfectly 18-25°SR.

The said leaf scrap defibrilation refers to that: after leaf scrap is extracted by hot water and separated into solid and liquid, it is defibrilated by general equipment well known professionally, and the beating degree of leaf scrap fiber finally into finished slurry is 14-30°SR, perfectly 18-25°SR.

Further improvement is to combine tobacco dust into tobacco stem fiber and leaf scrap fiber. The process point of combining tobacco dust can be selected at one or more of five process points such as slurry pool, pipeline from slurry stabilization box to slurry flow box, wire of papermaker machine, position from suction drain to first press or coating position of the papermaker machine, combining proportion of tobacco dust is 5%-30% in dry slurry weight. The said tobacco dust refers to that in 1 mm-100 mesh diameter formed in cigarette production process, or scraps in diameter over 100 mesh produced by low-grade tobacco and in threshing-redrying process, which is difficult to be used in its followed process. These scraps shall be ground by grinder into size suitable to process.

Before combining tobacco dust, defibrilated non-tobacco fiber can be added.

Non-tobacco fiber includes hemp pulp fibers such as flax, bluish dogbane, jute, ramie and all of hemp-made fiber products, straw pulp fiber such wheat straw, Chinese alpine rush, reed and all of straw-made fiber products, wood pulp fiber such as conifer pulp, broadleaf pulp and all of wood-made fiber products. The adding proportion is 4-20% in weight, perfectly 6-12%.

Defibrilation of non-tobacco fiber is to defibrilate it by general equipment well known professionally; its beating degree is controlled at 12-24°SR, and perfectly 16-20°SR.

Tobacco dust combining at process point of slurry pools mentioned above refers to all of slurry pools that are passed through by tobacco stem and leaf scrap after they are defibrilated respectively, including transition slurry pool, tobacco stem pool, leaf scrap pool, mixing pool and finished slurry pool, the tobacco dust can be added in form of dry tobacco dust or wet tobacco dust.

Wherein, combining dry tobacco dust refers to direct adding of dry tobacco dust into slurry pool to mix with slurry homogeneously; combining wet tobacco dust refers to mixing dry tobacco dust with water and binder materials and etc to form a wet tobacco dust that is then added into slurry pool to mix with slurry homogeneously. The said binder material includes CMC, starch, modified starch, xanthan gum, Guar gum and etc.

There are also two combining manners of wet tobacco dust and dry tobacco dust at process point of slurry flow pipeline from slurry stabilization box to slurry flow box.

Combining dry tobacco dust at process point of slurry pipeline from slurry stabilization box to slurry flow box refers to mixing dry tobacco dust or dry leaf scrap dust in diameters of 20-60 mesh into pulp wholly or partly before it formed on wire, and then the dust-mixed pulp is formed sheet base on wire. Adding wet tobacco dust at process point of slurry flow pipeline from slurry stabilization box to slurry flow box refers to first mixing tobacco dust or leaf scrap in diameter of 2 mm-60 mesh with water wholly or partly to make wet tobacco dust, and then mixed with the pulp to form the sheet base.

Combining tobacco dust at process point of wire on papermaking machine refers to adding tobacco dust in diameter of 40-100 mesh on the wire of papermaking machine from the parts of gravity drain to the part of suction drain on wire of the papermaking machine. Practical operation refers to uniformly splashing tobacco dust onto wet slurry on the wire.

Combining tobacco dust at process point from vacuum couch to first pressing refers to adding tobacco dust in diameter of 40-80 mesh on base beginning from its transference by vacuum couch to its end of first press process. Practical operation refers to uniformly splashing tobacco dust onto wet base on transferring felt (net).

The said combining tobacco dust at process point of coating position on papermaking machine refers to adding tobacco dust at process point of coating tobacco sheet extract and adding additives on papermaking machine.

For the said combining tobacco dust at process point of coating position on papermaking machine, the coating position includes first coating and second coating at any point or two points for simultaneously coating.

For the said combining tobacco dust at process point of coating position on papermaking machine, the tobacco dust is in mesh of 20-100, perfectly 40-80 mesh.

For the said combining tobacco dust at process point of coating position on papermaking machine, there are two manners: directly adding tobacco dust and adding combined tobacco dust/gum phase.

For the said combining tobacco dust at process point of coating position on papermaking machine, two stirring manners, mechanical or supersonic, can be used for keeping tobacco duct homogeneously in coating tank.

For the said combining tobacco dust at process point of coating position on papermaking machine, the gum used includes CMC, starch, modified starch, xanthan gum, Guar gum and etc.

Drying, threshing and shaping tobacco sheet refers to well-known technologies in this professional field, which can be used to prepare tobacco sheet into workable status.

The tobacco sheet manufactured by the tobacco sheet production method revealed in this invention has excellent quality that does not exist in tobacco sheet produced by traditional method. Its excellent characters are increased aroma and flavor abundance and decreased woody note, and at least obvious nature tobacco aroma and less woody note if evaluating the tobacco sheet produced by method disclosed in this invention according to <tobacco material cigarette smoking standard of PR China>. For the tobacco sheet produced by more perfect conditions, it has at least outstanding nature tobacco aroma and much less woody note.

Essential of this invention is to bring forward abnegation of tobacco stem extract according to tobacco sheet characters; adding tobacco dust at one or more process points mentioned in this invention, and relatively altering beating degree of tobacco stem defibrilation and beating degree scheme for the leaf scrap defibrilation, and also to put forward practical scheme. The papermaking tobacco sheet produced by this method has its improved performances from filling capacity to physical parameters, and more importantly, this method has obviously improved smoking quality with nature tobacco aroma for papermaking tobacco sheet, and increased papermaking tobacco sheet proportion in cigarette composition.

This invention reveal combining tobacco dust technics in papermaking tobacco sheet production method to improve filling capacity of papermaking tobacco sheet, and solves technical problems such as worse sensory quality, heavier woody note and poor tobacco aroma that exists in traditional papermaking tobacco sheet. In addition, it also solves utilization problem of waste tobacco dust resource in size of 2 mm-100 mesh, which produces in cigarette production process, thus it can save tobacco material and reduce cost. The invention may be illustrated by the following examples:

Example 1

Control

Tobacco stem 700 kg and leaf scrap 700 kg are immerged respectively by hot water of temperature 40° C. and 30° C. for 1.5 hours, and then extracted to obtain solid tobacco stem and solid leaf scrap, and liquid tobacco stem extract and liquid leaf scrap extract; first defibrilation's beating degree of solid tobacco stem is controlled at 10°SR and its second defibrilation's beating degree at 23°SR, and the beating degree of its tobacco stem fiber into finished slurry is 25°SR. Solid leaf scrap is defibrilated by traditional method. Beating degree of flax defibrilation is controlled at 12°SR. After it is defibrilated, it is added, in 6% of tobacco sheet weight, into all obtained tobacco stem fiber and leaf scrap fiber, which is then manufactured into fiber base by papermaking machine. Tobacco stem extract and leaf scrap extract is evaporated and concentrated, and is recombined on the formed sheet that is then dried, threshed and shaped.

Appearance inspection indicated that the sheet has loose structure, and tests verified that its physical properties and parameters are all eligible.

Expert group evaluated on the basis of their smoking that the characters of this sheet are poor aroma and flavor, sharp, fresh tobacco note, woody note and other impurity note, pasty aftertaste, over flavored, empty and less impact.

Example 2

Tobacco stem 700 kg and leaf scrap 700 kg are immerged respectively by hot water of temperature 40° C. and 30° C. for 1.5 hours, and then extracted to obtain solid tobacco stem and solid leaf scrap, and liquid tobacco stem extract and liquid leaf scrap extract; first defibrilation's beating degree of solid tobacco stem is controlled at 10°SR and its second defibrilation's beating degree at 23°SR, and the beating degree of its tobacco stem fiber into the finished slurry is 25°SR. Solid leaf scrap is defibrilated by traditional method. Beating degree of flax defibrilation is controlled at 12°SR. After it is defibrillated, it is added, in 6% of tobacco sheet weight, into all obtained tobacco stem fiber and leaf scrap fiber. Dry tobacco dust in diameter of 1 mm-60 mesh is added at process point of slurry flow pipeline from slurry stabilization box to slurry flow box in 30% weight proportion applying by dust adding device, which is then manufactured into fiber base by papermaking machine. Tobacco stem extract and leaf scrap extract is evaporated and concentrated, and the extracts immerged and coated (recombined) on the formed sheet that is then dried, threshed and packed.

Appearance inspection indicated that the sheet has loose structure, and tests verified that its physical properties and parameters are all eligible.

Expert group evaluated on the basis of their smoking that the characters of this sheet are abundance of aroma and flavor with better quality, rough, sharp, fresh tobacco note, less pasty aftertaste, over flavored, and medium impact.

Example 3

Tobacco stem 700 kg and leaf scrap 700 kg are immerged respectively by hot water of temperature 40° C. and 30° C. for 1.5 hours, and then extracted to obtain solid tobacco stem and solid leaf scrap, and liquid tobacco stem extract and liquid leaf scrap extract; first defibrilation's beating degree of solid tobacco stem is controlled at 10°SR and its second defibrilation's beating degree at 23°SR, and the beating degree of its tobacco stem fiber into finished slurry is 25°SR. Solid leaf scrap is defibrilated by traditional method. Beating degree of flax defibrilation is controlled at 12°SR. After it is defibrillated, it is added, in 6% of tobacco sheet weight, into all obtained tobacco stem fiber and leaf scrap fiber. Dry tobacco dust in diameter of 1 mm-60 mesh is added at process point of slurry flow pipeline from slurry stabilization box to slurry flow box in 30% weight proportion applying by dust adding device, which is then manufactured into fiber base by papermaking machine. 50% of tobacco stem extract is abnegated, and rest 50% of tobacco stem extract and all of leaf scrap extract is evaporated and concentrated, and then is immerged and coated on the formed sheet that is then dried, threshed and packed.

Appearance inspection indicated that the sheet has loose structure, and tests verified that its physical properties and parameters are all eligible.

Expert group evaluated on the basis of their smoking that the characters of this sheet are abundance of aroma and flavor with better quality, little rough, little sharp, fresh tobacco note, woody note and other impurity note, less pasty aftertaste, and medium impact.

Example 4

Tobacco stem 700 kg and leaf scrap 700 kg are immerged respectively by hot water of temperature 40° C. and 30° C. for 1.5 hours, and then extracted to obtain solid tobacco stem and solid leaf scrap, and liquid tobacco stem extract and liquid leaf scrap extract; first defibrilation's beating degree of solid tobacco stem is controlled at 10°SR and its second defibrilation's beating degree at 23°SR, and the beating degree of its tobacco stem fiber into the finished slurry is 25°SR. Solid leaf scrap is defibrilated by traditional method. Beating degree of flax defibrilation is controlled at 12°SR. After it is defibrillated, it is added, in 6% of tobacco sheet weight, into all obtained tobacco stem fiber and leaf scrap fiber. Dry tobacco dust in diameter of 1 mm-60 mesh is added at process point of slurry flow pipeline from slurry stabilization box to slurry flow box in 30% weight proportion applying by dust adding device, which is then manufactured into fiber base by papermaking machine. 80% of tobacco stem extract is abnegated, and rest 20% of tobacco stem extract and all of leaf scrap extract is evaporated and concentrated, and then is immerged and coated on the formed sheet that is then dried, threshed and packed.

Appearance inspection indicated that the sheet has loose structure, and tests verified that its physical properties and parameters are all eligible.

Expert group evaluated on the basis of their smoking that the characters of this sheet are abundance of aroma and flavor with better quality, little rough, little sharp, fresh tobacco note, less woody note and other impurity note, almost clean aftertaste, and medium impact.

Example 5

Tobacco stem 700 kg and leaf scrap 700 kg are immerged respectively by hot water of temperature 40° C. and 30° C. for 1.5 hours, and then extracted to obtain solid tobacco stem and solid leaf scrap, and liquid tobacco stem extract and liquid leaf scrap extract; first defibrilation's beating degree of solid tobacco stem is controlled at 10°SR and its second defibrilation's beating degree at 23°SR, and the beating degree of its tobacco stem fiber into finished slurry is 25°SR. Solid leaf scrap is defibrilated by traditional method. Beating degree of flax defibrilation is controlled at 12°SR. After it is defibrillated, it is added, in 6% of tobacco sheet weight, into all obtained tobacco stem fiber and leaf scrap fiber. Dry tobacco dust in diameter of 1 mm-60 mesh is added at process point of slurry flow pipeline from slurry stabilization box to slurry flow box in 30% weight proportion applying by dust adding device, which is then manufactured into fiber base by papermaking machine. 95% of tobacco stem extract is abnegated, and rest 5% of tobacco stem extract and all of leaf scrap extract is evaporated and concentrated, and then is immerged and coated on the formed sheet that is then dried, threshed and packed.

Appearance inspection indicated that the sheet has loose structure, and tests verified that its physical properties and parameters are all eligible.

Expert group evaluated on the basis of their smoking that the characters of this sheet are abundance of aroma and flavor with better sensory quality, almost soft and smooth, fresh tobacco note, little woody note and other off-taste, almost clean aftertaste, and medium impact.

Example 6

Tobacco stem 700 kg and leaf scrap 700 kg are immerged respectively by hot water of temperature 40° C. and 30° C. for 1.5 hours, and then extracted to obtain solid tobacco stem and solid leaf scrap, and liquid tobacco stem extract and liquid leaf scrap extract; first defibrilation's beating degree of solid tobacco stem is controlled at 10°SR and its second defibrilation's beating degree at 23°SR, and the beating degree of its tobacco stem fiber into the finished slurry is 25°SR. Solid leaf scrap is defibrilated by traditional method. Beating degree of flax defibrilation is controlled at 12°SR. After it is defibrilated, it is added, in 6% of tobacco sheet weight, into all obtained tobacco stem fiber and leaf scrap fiber. Dry tobacco dust in diameter of 1 mm-60 mesh is added at process point of slurry flow pipeline from slurry stabilization box to slurry flow box in 30% weight proportion applying by dust adding device, which is then manufactured into fiber base by papermaking machine. All of tobacco stem extract is abnegated, but all of leaf scrap extract is evaporated and concentrated, and then is immerged and coated on the formed sheet that is then dried, threshed and packed.

Appearance inspection indicated that the sheet has loose structure, and tests verified that its physical properties and parameters are all eligible.

Expert group evaluated on the basis of their smoking that the characters of this sheet are abundance of aroma and flavor with better sensory quality, soft and smooth, fresh tobacco note, little woody note, clean aftertaste, and medium impact.

Example 7

Tobacco stem 700 kg and leaf scrap 700 kg are immerged respectively by hot water of temperature 70° C. for 1 hour and 60° C. for 0.5 hours, and then extracted to obtain solid tobacco stem and solid leaf scrap, and liquid tobacco stem extract and liquid leaf scrap extract. Solid tobacco stem is defibrilated by traditional method, and leaf scrap entered into the finished slurry at beating degree 18°SR of leaf scrap fiber. Beating degree of flax defibrilation is controlled at 16°SR. After it is defibrillated, it is added, in 6% of tobacco sheet weight, into all obtained tobacco stem fiber and leaf scrap fiber. Dry tobacco dust in diameter of 1 mm-60 mesh is added into finished slurry pool in 5% weight and is stirred homogeneously. The mixed slurry is then manufactured into fiber base by papermaking machine. All of tobacco stem extract is abnegated, but all of leaf scrap extract is evaporated and concentrated, and then is immerged and coated on the formed sheet base that is then dried, threshed and packed.

Appearance inspection indicated that the sheet has loose structure, and tests verified that its physical properties and parameters are all eligible.

Expert group evaluated on the basis of their smoking that the characters of this sheet are less abundance of aroma and flavor with better sensory quality, little soft and smooth, fresh tobacco note, little woody note, almost clean aftertaste, and medium impact.

Example 8

Tobacco stem 700 kg and leaf scrap 700 kg are immerged respectively by hot water of temperature 60±5° C. and 40±5° C. for 1.5 hours, and then extracted to obtain solid tobacco stem and solid leaf scrap, and liquid tobacco stem extract and liquid leaf scrap extract; first defibrilation's beating degree of solid tobacco stem is controlled at 15°SR and its second defibrilation's beating degree at 25°SR, and the beating degree of its tobacco stem fiber into the finished slurry is 30°SR. Solid leaf scrap enters into the finished slurry at its fiber beating degree of 25°SR. Defibrilation beating degree of wheat straw is controlled at 18°SR, and after defibrilation, it is added, in 12% sheet weight into all of obtained tobacco stem fiber and leaf scrap fiber. Dry tobacco dust in diameter of 40-60 mesh is added on wire of papermaking machine in 10% weight proportion applying by dust adding device to stir homogeneously, which is then manufactured into fiber base by papermaking machine. All of tobacco stem extract is abnegated, but all of leaf scrap extract is evaporated and concentrated, and then is immerged and coated onto the formed sheet that is then dried, threshed and packed.

Appearance inspection indicated that the sheet has loose structure, and tests verified that its physical properties and parameters are all eligible. Tobacco dust can be seen on upper dust surface.

Expert group evaluated on the basis of their smoking that the characters of this sheet are abundance of aroma and flavor with better sensory quality, soft and smooth, less woody note, clean aftertaste, and medium impact. This sheet has maintained nature tobacco aroma and the sensory quality is similar to nature tobacco.

Example 9

Tobacco stem 700 kg and leaf scrap 700 kg are immerged respectively by hot water of temperature 70° C. for 1.5 hours and 30° C. for 1.5 hours, and then extracted to obtain solid tobacco stem and solid leaf scrap, and liquid tobacco stem extract and liquid leaf scrap extract; first defibrilation's beating degree of solid tobacco stem is controlled at 12°SR and its second defibrilation's beating degree at 13°SR, and the beating degree of its tobacco stem fiber into finished slurry is 18°SR and the beating degree of its leaf scrap fiber into finished slurry is 14°SR. Defibrilation beating degree of softwood pulp is controlled at 18°SR, and after defibrillation, it is added into all of obtained tobacco stem fiber and leaf scrap fiber in 12% of sheet weight. Dry tobacco dust in size of 40-80 mesh is added at process point from vacuum couch to first press in amount of 10% weight and stirred homogeneously, and then it is formed by papermaking machine into fiber flake base. The tobacco stem extract is abnegated, but the leaf scrap extract is distilled and concentrated, and then is immerged and coated on the formed sheet that is then dried, threshed and packed.

Appearance inspection indicated that the sheet has loose structure, and tests verified that its physical properties and parameters are all eligible. Tobacco dust can be seen on upper dust surface.

Expert group evaluated on the basis of their smoking that the characters of this sheet are abundance of aroma and flavor with better sensory quality, soft and smooth, less woody note, clean aftertaste, and little to medium impact. This sheet has maintained nature tobacco aroma and the sensory quality is similar to nature tobacco.

Example 10

Tobacco stem 700 kg and leaf scrap 700 kg are immerged respectively by hot water of temperature 60±5° C. for 1.5 hours and 30±5° C. for 1.5 hours, and then extracted to obtain solid tobacco stem and solid leaf scrap, and liquid tobacco stem extract and liquid leaf scrap extract; first defibrilation's beating degree of solid tobacco stem is controlled at 10°SR and its second defibrilation's beating degree at 15°SR, and the beating degree of its tobacco stem fiber into finished slurry is 18°SR and the beating degree of its leaf scrap fiber into finished slurry is 25°SR. Defibrilation beating degree of bluish dogbane is controlled at 22°SR, and after defibrillation, it is added into all of obtained tobacco stem fiber and leaf scrap fiber in 20% of sheet weight. Dry tobacco dust in size of 40-100 mesh is added at first coating point in amount of 5% weight, and CMC in 1% weight is added to be stirred homogeneously with the leaf scrap extract, and then it is mat-formed by papermaking machine into fiber flake base. The tobacco stem extract is abnegated, but the leaf scrap extract is distilled and concentrated, and then is immerged and coated on the formed sheet that is then dried, threshed and shaped.

Appearance inspection indicated that the sheet has loose structure, and tests verified that its physical properties and parameters are all eligible. Tobacco dust can be seen on upper dust surface.

Expert group evaluated on the basis of their smoking that the characters of this sheet are abundance of aroma and flavor with good sensory quality, soft and smooth, less woody note, somewhat foreign taste from CMC, mouth coating, and little impact.

Example 11

Tobacco stem 700 kg and leaf scrap 700 kg are immerged respectively by hot water of temperature 50±5° C. for 1.5 hours and 40±5° C. for 1.5 hours, and then extracted to obtain solid tobacco stem and solid leaf scrap, and liquid tobacco stem extract and liquid leaf scrap extract; first defibrilation's beating degree of solid tobacco stem is controlled at 14°SR and its second defibrilation's beating degree at 20°SR, and the beating degree of its tobacco stem fiber into finished slurry is 22°SR and the solid leaf scrap is defibrilated by traditional method. Defibrilation beating degree of straw is controlled at 20°SR, and after defibrillation, it is added into all of obtained tobacco stem fiber and leaf scrap fiber in 15% of sheet weight. Dry tobacco dust in size of 1 mm-60 mesh is added at slurry flow pipeline process point from slurry stabilization box to slurry flow box in amount of 20% sheet weight, and then it is formed by papermaking machine into fiber base. The tobacco stem extract is abnegated, but the leaf scrap extract is evaporated and concentrated, and then is immerged and coated on the formed sheet that is then dried, threshed and packed.

Appearance inspection indicated that the sheet has loose structure, and tests verified that its physical properties and parameters are all eligible.

Expert group evaluated on the basis of their smoking that the characters of this sheet are abundance of aroma and flavor with good sensory quality, less soft and smooth, less woody note, almost clean aftertaste and medium impact.

Example 12

Tobacco stem 700 kg and leaf scrap 700 kg are immerged respectively by hot water of temperature 40° C. for 2.5 hours and 50±5° C. for 1.5 hours, and then extracted to obtain solid tobacco stem and solid leaf scrap, and liquid tobacco stem extract and liquid leaf scrap extract; solid tobacco stem is defibrilated by traditional method and the beating degree of leaf scrap fiber into the finished slurry is 18°SR and the solid leaf scrap is defibrilated by traditional method. Defibrilation beating degree of jute is controlled at 8°SR, and after defibrillation, it is added into all of obtained tobacco stem fiber and leaf scrap fiber in 20% of sheet weight. Dry tobacco dust in size of 20-60 mesh is added into finished slurry pool in 20%, and then it is mat-formed by papermaking machine into fiber flake base. The tobacco stem extract is abnegated, but the leaf scrap extract is evaporated and concentrated, and then is immerged and coated on the formed sheet that is then dried, threshed and packed.

Appearance inspection indicated that the sheet has loose structure, and tests verified that its physical properties and parameters are all eligible.

Expert group evaluated on the basis of their smoking that the characters of this sheet are abundance of aroma and flavor with good sensory quality, little harsh and sharp, less woody note and fresh tobacco note, little off-taste, almost clean aftertaste, and medium to little impact.

Example 13

Tobacco stem 700 kg and leaf scrap 700 kg are immerged respectively by hot water of temperature 55±5° C. for 1.5 hours and 35±5° C. for 1.5 hours, and then extracted to obtain solid tobacco stem and solid leaf scrap, and liquid tobacco stem extract and liquid leaf scrap extract; solid tobacco stem is defibrilated by traditional method and the beating degree of leaf scrap fiber into finished slurry is 25°SR. Defibrilation beating degree of broadleaf pulp is controlled at 16°SR, and after defibrillation, it is added into all of obtained tobacco stem fiber and leaf scrap fiber in 9% of sheet weight. Dry tobacco dust in size of 40-80 mesh is added at long-net of papermaking machine in amount of 10% weight via dust adding device, and stirred homogeneously, and then it is formed by papermaking machine into fiber base. The tobacco stem extract is abnegated, but the leaf scrap extract is evaporated and concentrated, and then is immerged and coated on the formed sheet that is then dried, threshed and shaped.

Appearance inspection indicated that the sheet has loose structure, and tests verified that its physical properties and parameters are all eligible.

Expert group evaluated on the basis of their smoking that the characters of this sheet are abundance of aroma and flavor with good sensory quality, little harsh and sharp, less woody note, little off-taste, almost clean aftertaste, and medium to little impact.

Example 14

Tobacco stem 700 kg and leaf scrap 700 kg are immerged respectively by hot water of temperature 65±5° C. for 1.5 hours and 30±5° C. for 1.5 hours, and then extracted to obtain solid tobacco stem and solid leaf scrap, and liquid tobacco stem extract and liquid leaf scrap extract; first defibrilation of solid tobacco stem is controlled at beating degree of 10°SR and second defibrilation at 20°SR. The beating degree of tobacco stem fiber into finished slurry is 22°SR. Solid leaf scrap is defibrilated by traditional method. Defibrilation beating degree of Chinese alpine rush fiber is controlled at 22°SR, and after defibrillation, it is added into all of obtained tobacco stem fiber and leaf scrap fiber in 12% of sheet weight. Dry tobacco dust in size of 40-80 mesh is added at process point from the vacuum couch to first press in amount of 10% weight, and stirred homogeneously, and then it is formed by papermaking machine into fiber base. The tobacco stem extract is abnegated, but the leaf scrap extract is evaporated and concentrated, and then is immerged and coated on the formed sheet that is then dried, threshed and packed.

Appearance inspection indicated that the sheet has loose structure, and tests verified that its physical properties and parameters are all eligible.

Expert group evaluated on the basis of their smoking that the characters of this sheet are less abundance of aroma and flavor with good sensory quality, less harsh and sharp, less woody note and fresh tobacco note, little off-taste, almost clean aftertaste, and medium to little impact.

Example 15

Tobacco stem 700 kg and leaf scrap 700 kg are immerged respectively by hot water of temperature 50±5° C. for 1.5 hours and 45±5° C. for 1.5 hours, and then extracted to obtain solid tobacco stem and solid leaf scrap, and liquid tobacco stem extract and liquid leaf scrap extract; first defibrilation of solid tobacco stem is controlled at beating degree of 12°SR and second defibrilation at 15°SR. The beating degree of tobacco stem fiber into the finished slurry is 18°SR and the beating degree of leaf scrap fiber into the finished slurry is 25°SR. Defibrilation beating degree of bulrush fiber is controlled at 16°SR, and after defibrillation, it is added into all of obtained tobacco stem fiber and leaf scrap fiber in 20% of sheet weight. Dry tobacco dust in size of 40-80 mesh and CMC is added at fist coating place respectively in amount of 10% weight and 1% weight to mix with leaf scrap extract and to stir them homogeneously, and then it is formed by papermaking machine into fiber base. The tobacco stem extract is abnegated, but the leaf scrap extract is evaporated and concentrated, and then is immerged and coated on the formed sheet that is then dried, threshed and packed.

Appearance inspection indicated that the sheet has loose structure, and tests verified that its physical properties and parameters are all eligible.

Expert group evaluated on the basis of their smoking that the characters of this sheet are less abundance of aroma and flavor with good sensory quality, less harsh and sharp, less woody note and fresh tobacco note, little off-taste, almost clean aftertaste, and medium to little impact.

Example 16

Tobacco stem 700 kg and leaf scrap 700 kg are immerged respectively by hot water of temperature 60±5° C. for 1.5 hours and 30±5° C. for 1.5 hours, and then extracted to obtain solid tobacco stem and solid leaf scrap, and liquid tobacco stem extract and liquid leaf scrap extract. The obtained tobacco stem and solid leaf scrap fibers are added with defibrilated foreign fiber in 8% sheet weight, and then it is formed by papermaking machine into fiber base, The tobacco stem extract is abnegated, but the leaf scrap extract is evaporated and concentrated, and then is immerged and coated on the formed sheet that is then dried, threshed and packed.

Appearance inspection indicated that the sheet has loose structure, and tests verified that its physical properties and parameters are all eligible.

Expert group evaluated on the basis of their smoking that the characters of this sheet are empty of aroma and flavor, harsh and sharp, woody note and fresh tobacco note, off-taste, clean aftertaste, over-flavored and little impact.

The invention claimed is:

1. A method for producing papermaking flue-cured type tobacco sheet includes the steps as follows: (a) to immerge and to extract tobacco stem and leaf scrap respectively by water-soluble solvents to respectively obtain solid tobacco stem and solid leaf scrap, and tobacco stem extract and leaf scrap extract via solid/liquid separation; (b) to defibrilate solid tobacco stem and solid leaf scrap respectively, to mix the obtained tobacco stem fiber and leaf scrap fiber to prepare fiber flake base; (c) to wholly or partly abnegate the tobacco stem extract obtained by Step (a), and to evaporate and to concentrate other extracts that then are sprayed or immerged to coat the formed fiber base, (d) to recompose the tobacco stem fiber and the leaf scrap fiber by combining tobacco dust at a process point selected from the group comprising slurry pool, pipeline position from slurry stabilization box to slurry flow box, long-web (wire) of paper making machine, position from vacuum couch to first press and coating position of papermaking machine; and adding the tobacco dust in a quantity of 5-30% of dry pulp weight, (e) that is then dried, threshed and shaped.

2. A method for producing papermaking flue-cured type tobacco sheet according to claim 1, characterized in tobacco stem defibrilation parameter: wherein, beating degree of first defibrilation at 12-20°SR; beating degree of second defibrilation at 13-26°SR; beating degree of tobacco stem fiber finally into the finished slurry is 18-25°SR.

3. A method for producing papermaking flue-cured type tobacco sheet according to claim 1, characterized in leaf scrap defibrilation parameter: wherein, beating degree of leaf scrap fiber finally into the finished slurry is 18-25°SR.

4. A method for producing papermaking flue-cured type tobacco sheet according to claim 1, wherein additional added fibers in 4-20% weight, selectable from flax pulp fiber, straw pulp fiber and wood pulp fiber.

5. A method for producing papermaking flue-cured type tobacco sheet according to claim 4, which is characterized on the additional added fiber parameter of beating degree 16-20°SR.

6. A method for producing papermaking flue-cured type tobacco sheet according to claim 1, characterized in adding tobacco dust at process point of slurry pool, which refers to all of slurry pools that are passed through by tobacco stem and leaf scrap after they are defibrilated respectively, including transition slurry pool, tobacco stem pool, leaf scrap pool, mixing pool and finished slurry pool; and two adding manners, adding dry tobacco dust and adding wet tobacco dust.

7. A method for producing papermaking flue-cured type tobacco sheet according to claim 1, characterized in adding dry tobacco dust at process point on slurry flow pipeline from slurry stabilization box to slurry flow box, which refers to mix dry tobacco dust or leaf scrap dust in size of 20-40 mesh wholly or partly with slurry that is ready for mat-forming on net; adding wet tobacco dust at process point on slurry flow pipeline from slurry stabilization box to slurry flow box refers to mix tobacco dust or leaf scrap with water into wet tobacco dust, and then to mix them wholly or partly with slurry that is ready for forming on wire.

8. A method for producing papermaking flue-cured type tobacco sheet according to claim 1, characterized in adding tobacco dust at long-net process point of papermaking machine, which refers to adding tobacco dust in diameter of 40-100 mesh at water filtering net station of papermaking machine from slurry flow box to vacuum couch of the papermaking machine.

9. A method for producing papermaking flue-cured type tobacco sheet according to claim 1, characterized in adding tobacco dust at process point from vacuum couch to first press, which refers to adding tobacco dust in diameter of 40-80 mesh onto flake base beginning at transfer of vacuum couch and ending at first press over.

10. A method for producing papermaking flue-cured type tobacco sheet according to claim 1, characterized in adding tobacco dust at process point of coating position of papermaking machine, which refers to adding tobacco dust in diameter of 20-100 mesh, perfectly 40-80 mesh, at process point of coating extract onto the sheet and adding foreign additives at papermaking machine.

11. A flue-cured tobacco sheet that is characterized on this product prepared by the said preparation method according to claim 1.

* * * * *